US009289646B2

(12) United States Patent
Tully

(10) Patent No.: US 9,289,646 B2
(45) Date of Patent: Mar. 22, 2016

(54) WEIGHT BAR T-HANDLE AND PIVOT ANCHOR ASSEMBLY

(71) Applicant: Tommy Tully, Edmond, OK (US)

(72) Inventor: Tommy Tully, Edmond, OK (US)

( * ) Notice: Subject to any disclaimer, the term of this patent is extended or adjusted under 35 U.S.C. 154(b) by 0 days.

(21) Appl. No.: 14/544,814

(22) Filed: Feb. 20, 2015

(65) Prior Publication Data

US 2015/0297942 A1 Oct. 22, 2015

Related U.S. Application Data

(60) Provisional application No. 61/995,824, filed on Apr. 21, 2014.

(51) Int. Cl.

| | |
|---|---|
| ***A63B 21/06*** | (2006.01) |
| ***A63B 21/08*** | (2006.01) |
| ***A63B 21/062*** | (2006.01) |
| ***A63B 21/078*** | (2006.01) |
| ***A63B 21/00*** | (2006.01) |
| ***A63B 21/16*** | (2006.01) |
| ***A63B 23/12*** | (2006.01) |

(52) U.S. Cl.

CPC ..... *A63B 21/16* (2013.01); *A63B 21/08* (2013.01); *A63B 21/1469* (2013.01); *A63B 23/1209* (2013.01); *A63B 2021/169* (2013.01)

(58) Field of Classification Search

CPC ..... A63B 1/00; A63B 21/00; A63B 21/0004; A63B 21/00047; A63B 21/06; A63B 21/0608; A63B 21/0615; A63B 21/0616; A63B 21/0617; A63B 21/062; A63B 21/0626; A63B 21/072; A63B 21/0724; A63B 21/0726; A63B 21/0728; A63B 21/075; A63B 21/08; A63B 21/15; A63B 21/159; A63B 21/16; A63B 21/4033; A63B 21/4035; A63B 21/4041; A63B 21/4047; A63B 21/4049; A63B 22/00; A63B 22/0002; A63B 22/0046; A63B 22/0048; A63B 22/0056; A63B 22/0058; A63B 23/00; A63B 23/03516; A63B 23/0355; A63B 23/12; A63B 23/1209; A63B 2208/0204

USPC ..... 482/93–94, 97, 100, 104, 136–137, 139

See application file for complete search history.

(56) References Cited

U.S. PATENT DOCUMENTS

| | | | | | |
|---|---|---|---|---|---|
| 1,973,593 | A * | 9/1934 | Willner | A63B 23/12 | 482/92 |
| 3,235,255 | A | 2/1966 | Leflar | | |
| 3,690,655 | A * | 9/1972 | Chapman | A63B 21/072 | 482/109 |
| 3,784,195 | A * | 1/1974 | Johnson | A63B 23/00 | 482/123 |
| 4,140,315 | A | 2/1979 | Page, Jr. | | |
| 4,323,236 | A * | 4/1982 | Szabo | A63B 21/0615 | 482/97 |
| 4,344,619 | A * | 8/1982 | Szabo | A63B 21/0615 | 248/161 |
| 4,357,010 | A * | 11/1982 | Telle | A63B 21/00072 | 482/113 |
| 4,572,505 | A * | 2/1986 | Kornhaus | A63B 21/0615 | 482/79 |
| 4,603,856 | A * | 8/1986 | Fiore | A63B 21/015 | 482/114 |
| 4,657,245 | A * | 4/1987 | Smith | A63B 21/0615 | 482/94 |

(Continued)

*Primary Examiner* — Oren Ginsberg
*Assistant Examiner* — Joshua Lee
(74) *Attorney, Agent, or Firm* — Randal D. Hamburg

(57) ABSTRACT

A weight training assembly which attaches to a weight bar to train an athlete in upward thrust movements, specifically football linemen, the assembly including a T-handle attachment for application to one end of the weight bar and an anchor attachment mounted to the floor or a floor and wall junction securing the other end of the weight bar for pivotal movement, the T-handle portion held by the user for a standing military press motion or other creative lifting movement.

4 Claims, 6 Drawing Sheets

(56) References Cited

U.S. PATENT DOCUMENTS

| | | | | | |
|---|---|---|---|---|---|
| 4,828,252 | A | | 5/1989 | Bowen | |
| 4,834,364 | A | * | 5/1989 | Gongwer | A63B 23/00 482/131 |
| 5,143,372 | A | | 9/1992 | Wilson | |
| 5,207,624 | A | * | 5/1993 | Paskovich | A63B 21/072 482/106 |
| 5,244,444 | A | * | 9/1993 | Wostry | A63B 21/0615 482/109 |
| 5,310,393 | A | * | 5/1994 | Highsmith | A63B 21/0615 482/148 |
| D384,710 | S | * | 10/1997 | Pahel | D21/694 |
| 6,030,323 | A | * | 2/2000 | Fontenot | A63B 21/0083 482/111 |
| 7,141,002 | B2 | * | 11/2006 | Connelly | A63B 21/0728 482/109 |
| 7,267,640 | B2 | * | 9/2007 | Patton | A63B 21/0004 482/128 |
| 7,476,183 | B1 | * | 1/2009 | Chrest | A63B 21/072 482/908 |
| 7,559,881 | B1 | * | 7/2009 | Roraff | A63B 21/023 482/126 |
| 7,608,020 | B2 | * | 10/2009 | Mason | A63B 21/0615 482/105 |
| D659,779 | S | | 5/2012 | Gray | |
| 8,177,692 | B2 | * | 5/2012 | Deppen | A63B 21/0728 434/226 |
| 8,444,533 | B2 | | 5/2013 | Robinson | |
| 8,974,354 | B1 | * | 3/2015 | Nelson | A63B 21/08 482/94 |
| 2003/0162638 | A1 | * | 8/2003 | Verheem | A63B 21/05 482/123 |
| 2004/0242383 | A1 | * | 12/2004 | Karlstrom | A63B 21/0083 482/93 |
| 2005/0176558 | A1 | * | 8/2005 | Huang | A63B 21/06 482/93 |
| 2007/0155596 | A1 | * | 7/2007 | Rogers | A63B 21/0615 482/97 |
| 2007/0249472 | A1 | * | 10/2007 | Frei | A45B 1/02 458/66 |
| 2010/0242644 | A1 | * | 9/2010 | Farbshteyn | A63B 21/0615 74/102 |
| 2014/0073492 | A1 | * | 3/2014 | Hunter | A63B 21/0615 482/98 |

* cited by examiner

WEIGHT BAR T-HANDLE AND PIVOT ANCHOR ASSEMBLY

CROSS REFERENCE TO RELATED APPLICATIONS

Applicant claims the benefit of Provisional Patent No. 61/955,824, filed by the same inventor on Apr. 21, 2014.

I. BACKGROUND OF THE INVENTION

1. Field of Invention

A weight training assembly which attaches to a weight bar to train an athlete in upward thrust movements, specifically football linemen, the assembly including a T-handle attachment for application to one end of the weight bar and an anchor attachment mounted to the floor or a floor and wall junction securing the other end of the weight bar for pivotal movement, the T-handle portion held by the user for a standing military press motion or other creative lifting movement.

2. Description of Prior Art

A preliminary review of prior art patents was conducted by the applicant which reveal prior art patents in a similar field or having similar use. However, the prior art inventions do not disclose the same or similar elements as the present weight training device, nor do they present the material components in a manner contemplated or anticipated in the prior art.

II. SUMMARY OF THE INVENTION

Weight training devices are used to increase strength and muscle memory by designed motion in the presence of a weighted mass or force. They come in several embodiment including elastic bands, resistance machines and free weight devices. They come in various sizes and require different sized areas for use. Different weight devices have proven effective to teach certain movements for different physical actions and develop athletes' strength, motion and acuity to enhance their athletic skills.

A standing military press is a movement that is important to a football lineman. The specific motion utilized by these athletes generally starts from a squatted position or a three and four point stance. From that starting position, the next movement is an explosive upward standing thrust with a forceful upward arm movement, as to lift and push an opponent backwards away from the line and upward to reduce the opponents ability to exert an opposing force, causing the opponent to lose balance and thus an opposing force. This movement is quick and explosive.

The present device is presented in two pieces—one which is mounted to the floor and/or wall and attaches to a standard weight bar used in fee weight lifting, shown in the drawings, and the other attaching to a T-handle. The T-handle is held by the user at chest level while in a squat position and may be loaded with a desired weight. The t-handle is then thrust upward and outward while the user stands quickly. The T-handle is then returned as the user returns to a squat and repeats the upward thrust until the exercise is complete. As may be obvious from the embodiment as shown, other exercises may be derived from the assembly and weight bar combination.

III. DESCRIPTION OF THE DRAWINGS

The following drawings are submitted with this utility patent application.

IV. DESCRIPTION OF THE PREFERRED EMBODIMENT

Figure 1:
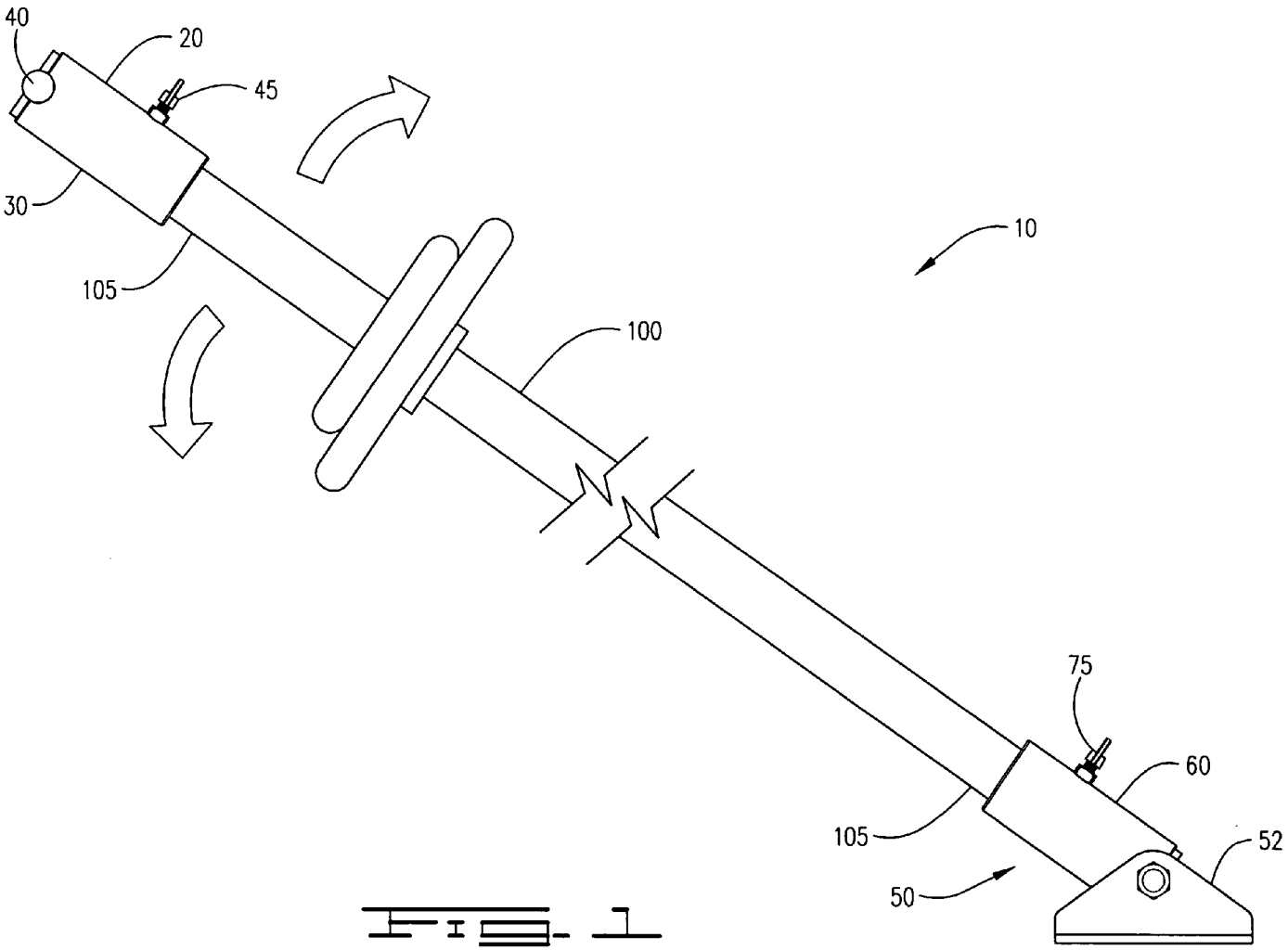
FIG. 1 is a view of the weight bar, the T-handle portion and the pivot anchor assembly.
Figure 2:
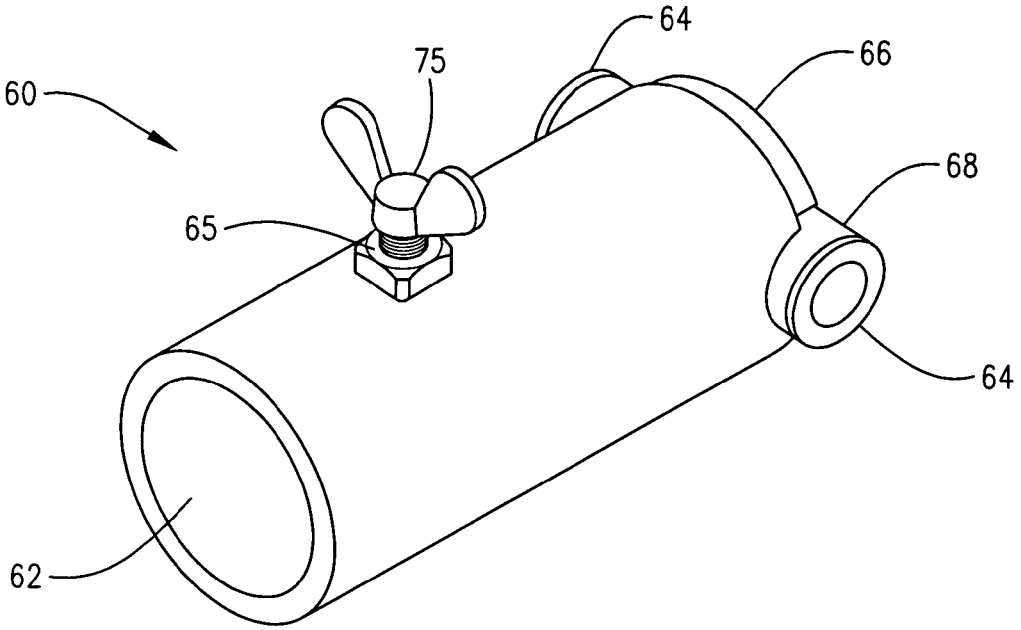
FIG. 2 is a first perspective of the end cap of the pivot anchor assembly.
Figure 3:
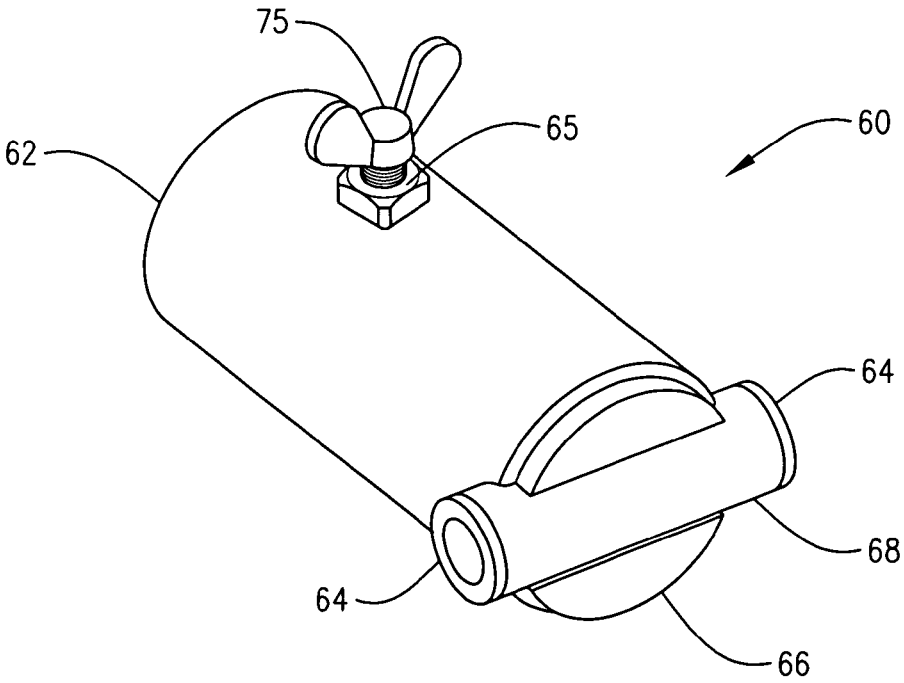
FIG. 3 is a reverse perspective view of the end cap of the pivot anchor assembly from that shown in FIG. 2.
Figure 4:
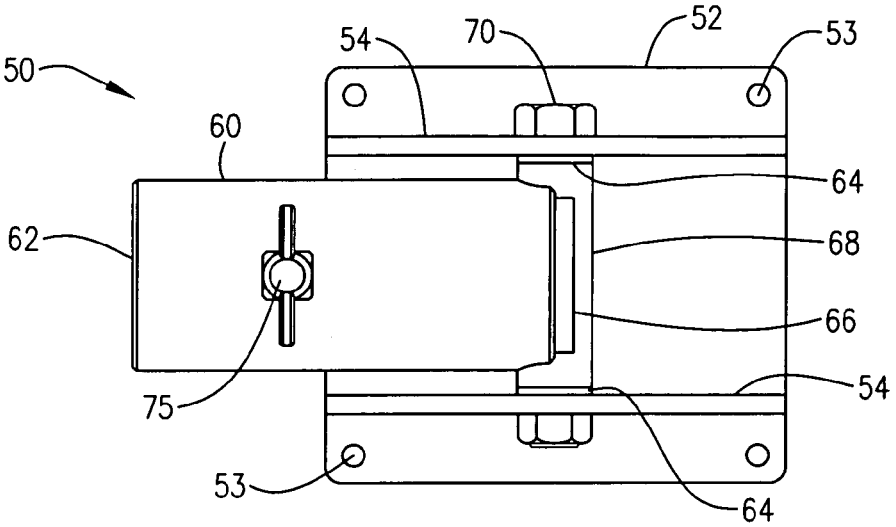
FIG. 4 is a top view of the pivot anchor portion.
Figure 5:
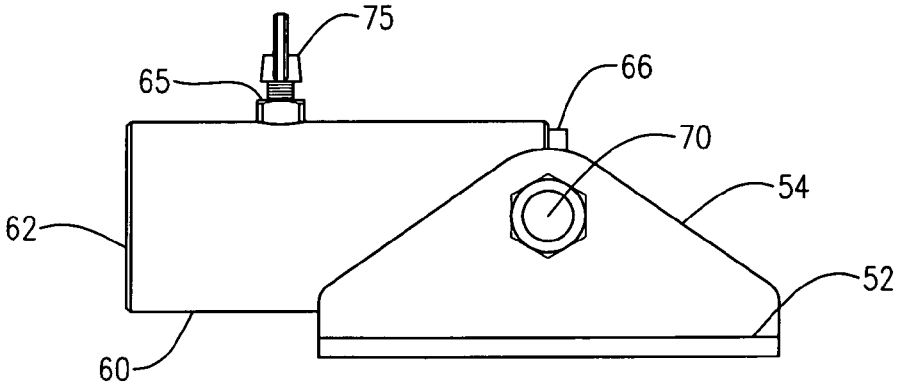
FIG. 5 is a side view of the pivot anchor portion.
Figure 6:
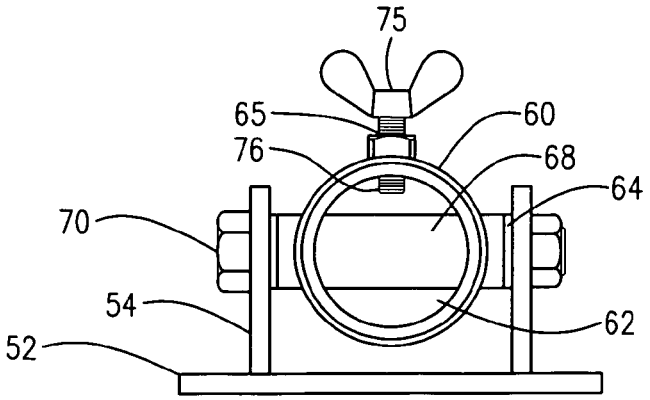
FIG. 6 is a front view of the pivot anchor portion.
Figure 7:
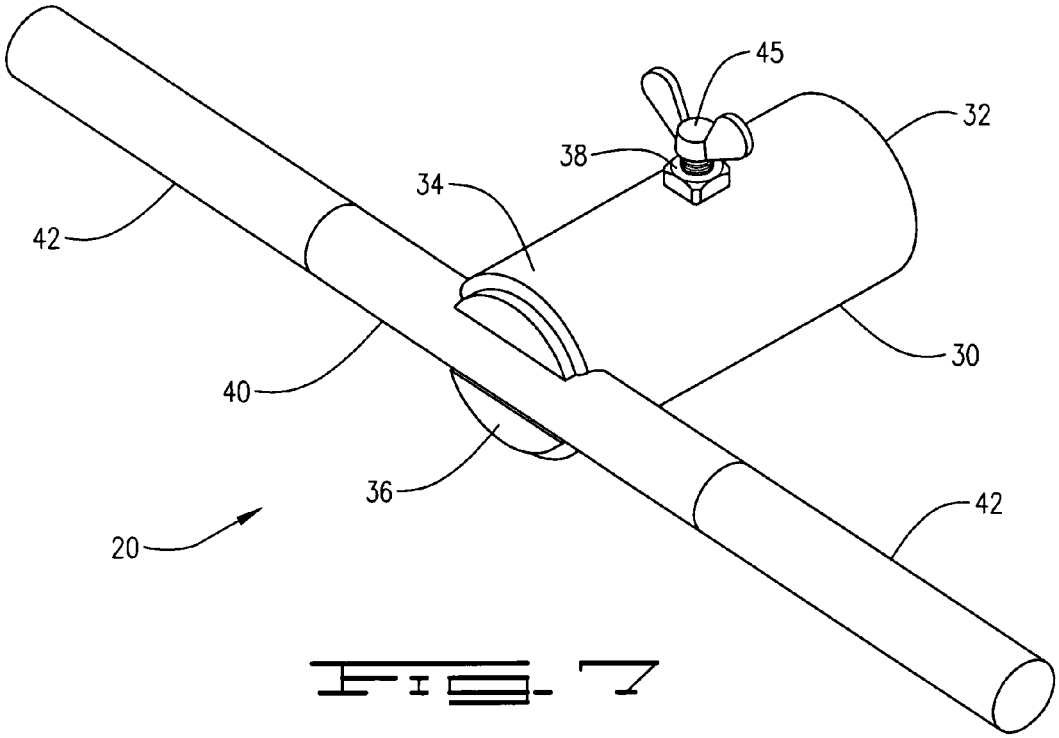
FIG. 7 is a perspective view of the T-handle portion.
Figure 8:
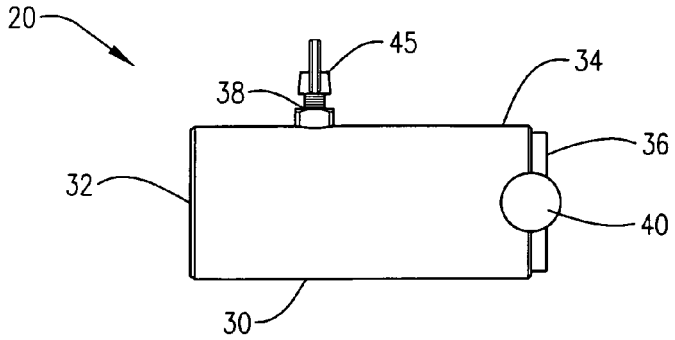
FIG. 8 is a side view of the T-handle portion.
Figure 9:
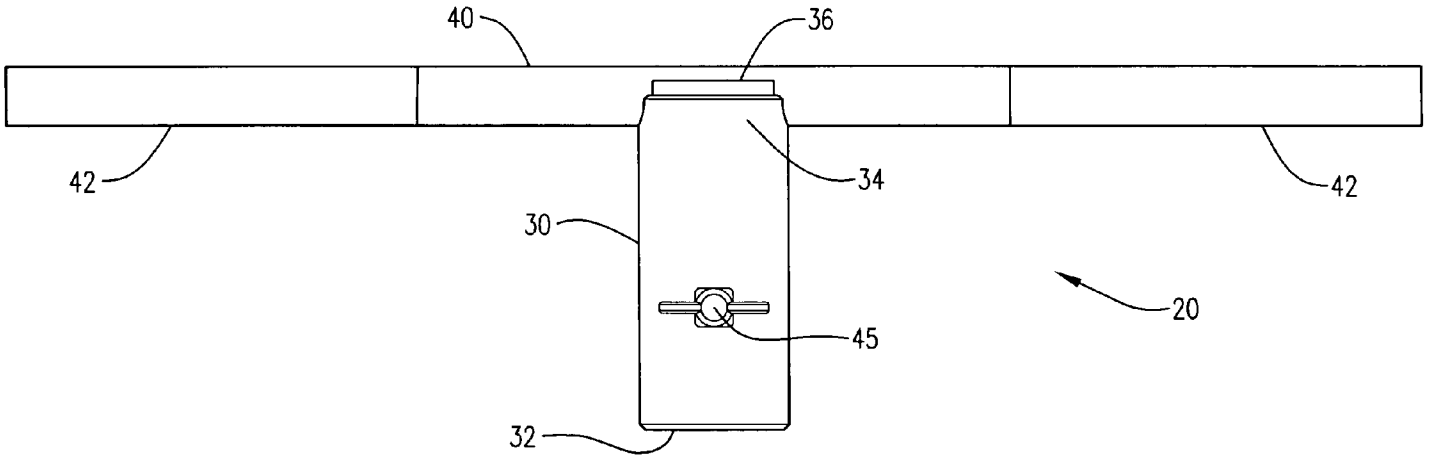
FIG. 9 is a top view of the T-handle portion.
Figure 10:
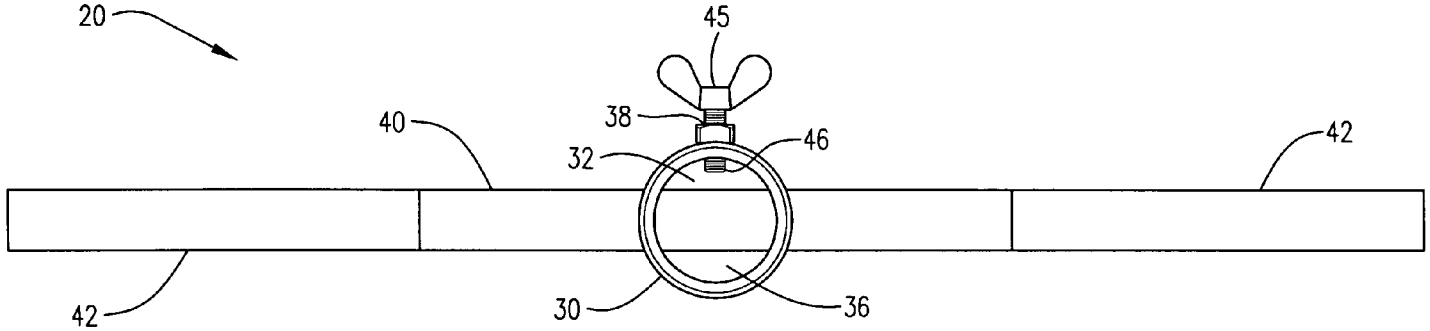
FIG. 10 is an end view of the T-handle portion.

A weight bar T-handle and pivot anchor assembly 10, utilizing a weight bar 100 commonly used in free weight lifting as shown in FIGS. 1-11, provides two elements which attach to the ends 105 of the weight bar 100, the assembly comprising a T-handle portion 20 and a pivot anchor portion 50. The T-handle portion 20, FIGS. 7-11, defines a cylindrical sleeve 30 having a lower opening 32 accepting an end 105 of the weight bar 100 and an upper end 34 defining an end cap 36 attaching a T-bar handle 40 defining outer grip segments 42. The cylindrical sleeve 30 further defines a threaded lateral bore 38 and a side oriented lock screw 45 to secure the end 105 of the weight bar 100 within the lower opening 32, the lock screw 45 having a threaded end 46 encroaching within the opening 32, FIG. 10, through the threaded lateral bore 38.

The pivot anchor portion 50, FIGS. 2-6 and 11, defines a base frame 52 upwardly depending a pair of vertical side panels 54, each panel 54 having an axially aligned central bore 55. A cylindrical pivotal member 60 defines an opening 62 adapted to receive an end 105 of the weight bar 100 opposite the end attached within the T-handle portion 20 and is pivotally attached through a transverse pin barrel 68 on a rear segment 66 of the cylindrical pivot member 60 by a pin 70, further traversing and engaging the aligned central bores 55 of the vertical side panels 54 of the pivot anchor portion 50, the side panels 54 restricting movement of the cylindrical pivot member 60 to up and down only with no lateral movement allowed. This limitation of function can be further accomplished by the inclusion of a pair of bushings 64 between each side panel 54 and the transverse pin barrel 68, as seen in FIGS. 2-4 and 6. The cylindrical pivotal member 60 provides at least one lateral threaded bore 65 with a lock screw 75 to secure the end 105 of the weight bar 100 anchored within the cylindrical pivot member's opening 62, the lock screw 75 having a threaded end 76 encroaching within the opening 62 in the cylindrical pivot member 60, FIG. 6.

The base frame 52 is attached to a wall, floor or both the wall and floor through a plurality of base frame holes 53 by appropriate means to firmly attach the base plate 52 to a wall or a floor by sufficient means, not shown or claimed, which would eliminate the base frame 52 from becoming dislodged by movement during use and also to eliminate movement of the pivot anchor portion 50 beyond that indicated within the movement disclosed herein.

Figure 11:
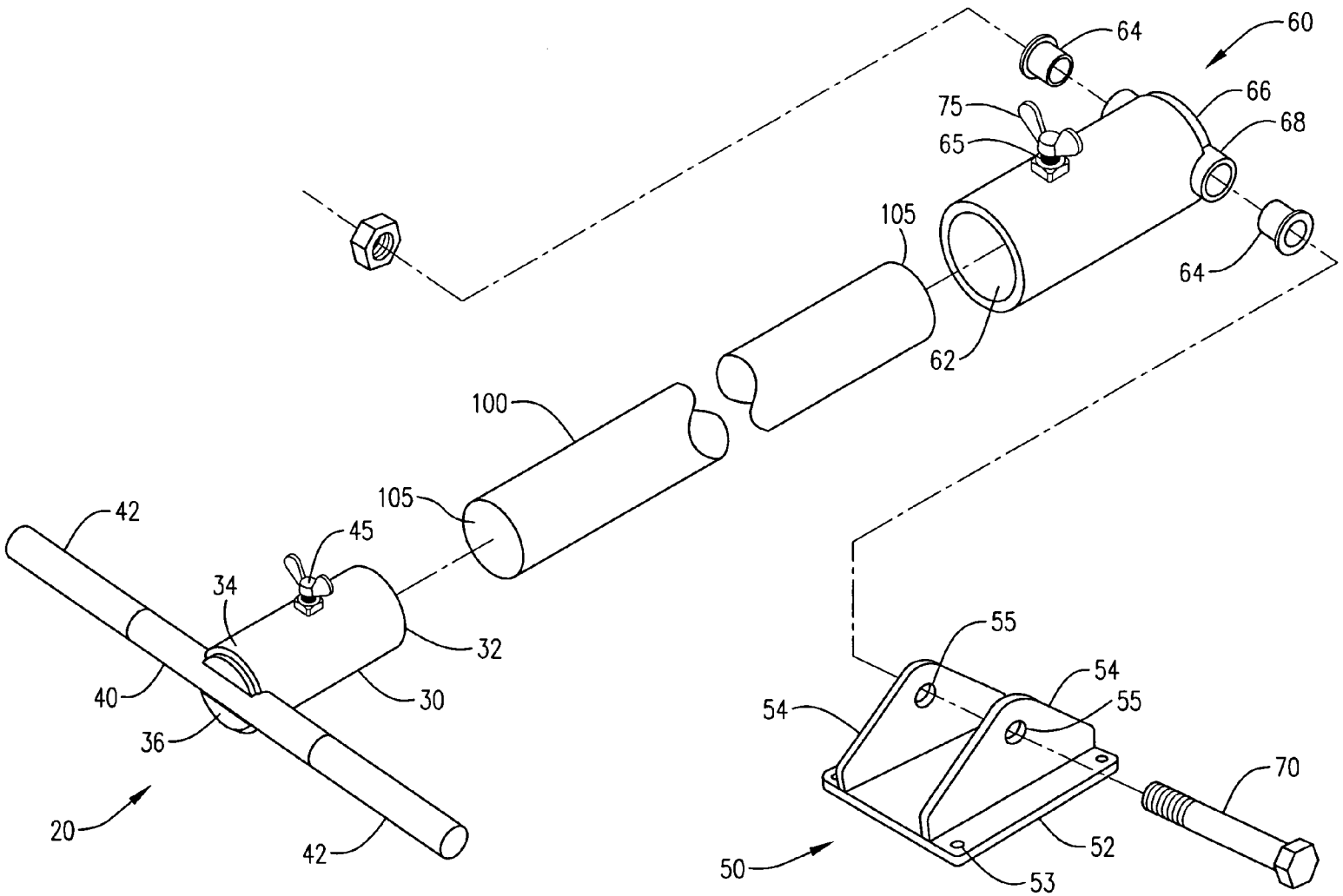
FIG. 11 is an exploded view of the T-handle portion and pivot anchor portion along with a segment of a weight bar.

In combination, the T-handle portion 20 and the pivot anchor portion 50 attach the weight bar 100, FIGS. 1 and 11. The assembly forms an elongated lever secured to the floor which is pivotal. The weight bar 100 may include additional weight applied in the same manner as if the weight bar were used without the assembly and as selected by the user for an appropriate level of weight training suited for the user, FIG. 1. The weights would be added and removed by simple removal of the T-handle portion 20 and then reapplication once the weight amount is installed on the weight bar 100. The preferred weight training is a standing military press maneuver or a somewhat forward angled squat thrust. This is merely one type of exercise that can be conducted using the assembly. A weight or strength training coach or expert may develop other suitable exercises using the assembly which are not disclosed in the present application, and thus, the use of the assembly should not be limited to the drawings or the disclosed uses herein.

The T-handle portion 20 should also not be limited to the drawing figures, especially as to the configuration of the T-bar handle 40. As shown in FIGS. 7-11, the T-bar handle 40 is a straight bar welded to the upper end 34 of the cylindrical sleeve 30. However, the T-bar handle 40 is contemplated to be configured in shape and size to a curling bar, elevated handles, a pivotal handle attached within an upper horizontal sleeve, or any other shaped configuration, as long as at least one grip segment 42 is exposed beyond the cylindrical sleeve 30 in one manner or another.

While the invention has been particularly shown and described with reference to a preferred embodiment thereof, it will be understood by those skilled in the art that changes in form and detail may be made therein without departing from the spirit and scope of the invention.

What is claimed is:

1. A weight bar T-handle and pivot anchor assembly incorporating a weight lifting bar used in free weight lifting comprising:

a T-handle portion defining a cylindrical sleeve having a lower opening accepting an end of the weight lifting bar and an upper end defining an end cap attaching a T-bar handle defining outer grip segments; and a pivot anchor portion defining a base frame attaching a pair of upwardly depending vertical side panels, each panel having an axially aligned central bore and a cylindrical pivot member defining an opening adapted to receive an opposing end of the weight lifting bar, said cylindrical pivot member pivotally attached through a transverse pin barrel on a rear segment of said cylindrical pivot member by a pin traversing and engaging said aligned central bores of said vertical side panels of said pivot anchor portion, said side panels confining movement of said cylindrical pivot member vertically with completely restricted lateral movement.

2. The weight bar T-handle and pivot anchor assembly according to claim 1, said cylindrical sleeve further comprising a threaded lateral bore and a side oriented lock screw securing said end of said weight lifting bar within said lower opening, said lock screw having a threaded end encroaching within said opening through said threaded lateral bore.

3. The weight bar T-handle and pivot anchor assembly according to claim 1, wherein said pivot anchor portion further comprises:

a pair of bushings between each said side panel and said transverse pin barrel;

said cylindrical pivot member providing at least one lateral threaded bore with a lock screw to secure said end of said weight lifting bar anchored within said opening of said cylindrical pivot member, said lock screw having a threaded end encroaching within said opening in said cylindrical pivot member through said at least one lateral threaded bore; and said base frame is attached to a wall or floor through a plurality of base frame holes by an attaching means firmly attaching said base plate to said wall or floor preventing said base frame dislodgment or movement during use and also to eliminate movement of said pivot anchor portion beyond the limitations set forth herein.

4. The weight bar T-handle and pivot anchor assembly according to claim 1, wherein said T-bar handle is selected from a group of shaped handles comprising a straight bar, a curling bar, a bar with elevated said grip segments, or any other shaped configuration, as long as at least one said grip segment is exposed beyond said cylindrical sleeve.

* * * * *